US007165997B1

(12) United States Patent
Hou

(10) Patent No.: US 7,165,997 B1
(45) Date of Patent: Jan. 23, 2007

(54) MINI SECURE DIGITAL CARD CONNECTOR

(75) Inventor: Chih-Yuan Hou, Tucheng (TW)

(73) Assignee: Cheng Uei Precision Industry Co., Ltd., Taipei (TW)

( * ) Notice: Subject to any disclaimer, the term of this patent is extended or adjusted under 35 U.S.C. 154(b) by 0 days.

(21) Appl. No.: 11/331,148

(22) Filed: Jan. 13, 2006

(30) Foreign Application Priority Data

Oct. 20, 2005 (TW) ..... 94218114 U

(51) Int. Cl.
*H01R 24/00* (2006.01)

(52) U.S. Cl. ..... 439/630

(58) Field of Classification Search ..... 439/630, 439/625, 152
See application file for complete search history.

(56) References Cited

U.S. PATENT DOCUMENTS 6,468,101 B1 * 10/2002 Suzuki ..... 439/326
6,623,304 B1 * 9/2003 Harasawa et al. ..... 439/630
6,666,724 B1 * 12/2003 Lwee ..... 439/630
6,902,435 B1 * 6/2005 Cheng ..... 439/630
6,929,513 B1 * 8/2005 Fan ..... 439/630
6,932,654 B1 * 8/2005 Washino ..... 439/630
6,951,472 B1 * 10/2005 Shih ..... 439/326
6,955,566 B1 * 10/2005 Matsunaga et al. ..... 439/630
2003/0022537 A1 * 1/2003 Bricaud et al. ..... 439/152

* cited by examiner

*Primary Examiner*—Tulsidas C. Patel
*Assistant Examiner*—Harshad C Patel
(74) *Attorney, Agent, or Firm*—Rosenberg, Klein & Lee

(57) ABSTRACT

A mini secure digital (SD) card connector includes an insulation body, a movable cover and a plurality of insertion terminals. The insulation body has a plurality of channels to receive insertion terminals and at least one jam bulge arranged in the front end of the insulation body to wedge with front side of a mini SD card. The movable cover covers on the top of the insulation body. The movable cover is formed by a pressure plate, two side plates and a folded panel formed on the middle of the pressure plate. When a mini SD card is inserted the mini SD card connector, the mini SD card connector provides at least one jam bulge to lock the front side of the mini SD card, so that the signal contact portion of the mini SD card is locked correctly and firmly in the mini SD card connector.

3 Claims, 4 Drawing Sheets

MINI SECURE DIGITAL CARD CONNECTOR

BACKGROUND OF THE INVENTION

1. Field of the Invention

The invention relates to a mini secure digital (SD) card connector, and more particularly, to a mini secure digital card connector correctly and firmly locking mini SD cards.

2. The Related Art

Consuming electronic products, such as the mobile phone, the digital camera, PDA, MP3 etc., are designed for more functions and portability. The user of consuming electronic product has more demands, such as more capacity and less volume, so that the mini secure digital card comes up.

A mini secure digital (SD) card has dimensions of 20 mm×21.5 mm×1.4 mm, and an area of approximately a half of a thumb. Thus, compared to a standard SD card having dimensions of 32 mm×24 mm×2.1 mm, the mini SD card is much smaller. The mini SD card saves up to more than 40% with respect to an area required for printed circuit board (PCB) and even up to more than 60% with respect to a volume required when applied to portable devices. Because of the characteristic of the more capacity and the less volume, the mini SD cards are used on the mobile phones and lots of the consuming products. Conventional mini SD card connector comprises a housing for receiving the mini SD card. Since the mini SD card connector is very small, so that there is no further consideration to firmly hold the mini SD card.

Due to the small volume of the mini SD card, conventional SD card connector cannot apply to the handheld electronic devices. So that a new brand connector has been developed for receiving the mini SD card.

SUMMARY OF THE INVENTION

Therefore, the primary object of the invention is to provide a mini SD card connector especially tailoring for mini SD cards, which is extensively applied to a handheld device, such as multimedia mobile phones, digital static cameras (DSC), digital video cameras, MP3 players, recorders and global positioning systems. More particularly, the mini SD card connector according to the invention can be applied to the handheld device in order to firmly hole the mini SD card.

Another object of the invention is to provide a mini SD cards connector which comprises an insulation body having a plurality of channels to receive insertion terminals and at least one jam bulge arranged in the front end of the insulation body to wedge with front side of a mini SD card; a movable cover covering on the top portion of the insulation body and formed by a pressure plate, two side plates and a folded panel formed on the middle of the pressure plate and; and a plurality of insertion terminals arranged in the insulation body. The mini SD cards connector is designed in accordance with standard specifications of a mini SD card so as to appropriately place the signal contact portion of the mini SD card in correct directions. In addition, the jam bulges of the insulation body lock the front side of the mini SD card. Thus, the mini SD card is steadily located in the insulation body of the connector and forms good electric connection with the insertion terminals of the connector.

BRIEF DESCRIPTION OF THE DRAWINGS

The features of this invention which are believed to be novel are set forth with particularity in the appended claims. The invention, together with its objects and the advantages thereof may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
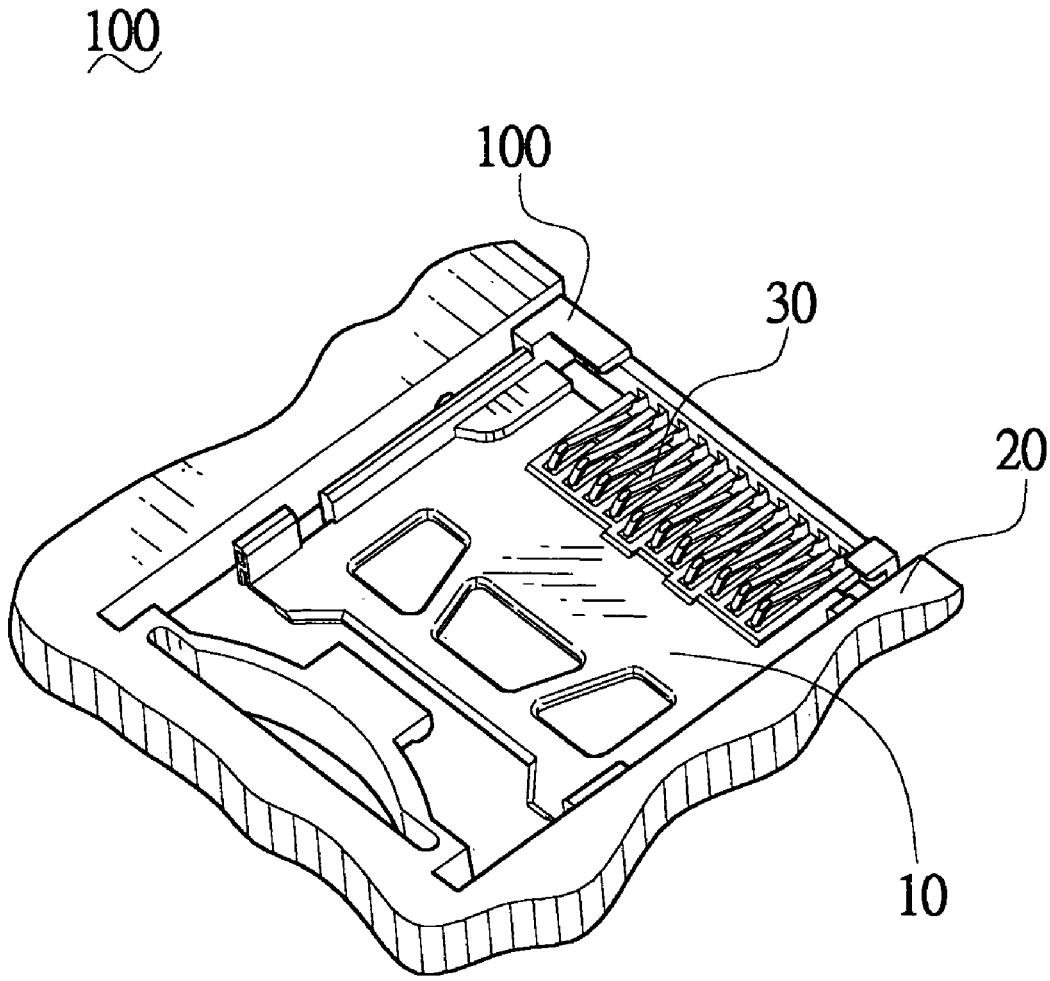
FIG. 1 is a perspective view of a mini SD card connector according to the present invention.

Referring to FIG. 1, a mini secure digital (SD) card connector 100 according to the invention comprises a longitudinal insulation body 10, a movable cover 20 covering on the top portion of the insulation body 10 and a plurality of insertion terminals 30 arranged in the insulation body 10. The movable cover 20 is formed at a back cover of a mobile phone (not shown).

Figure 2:
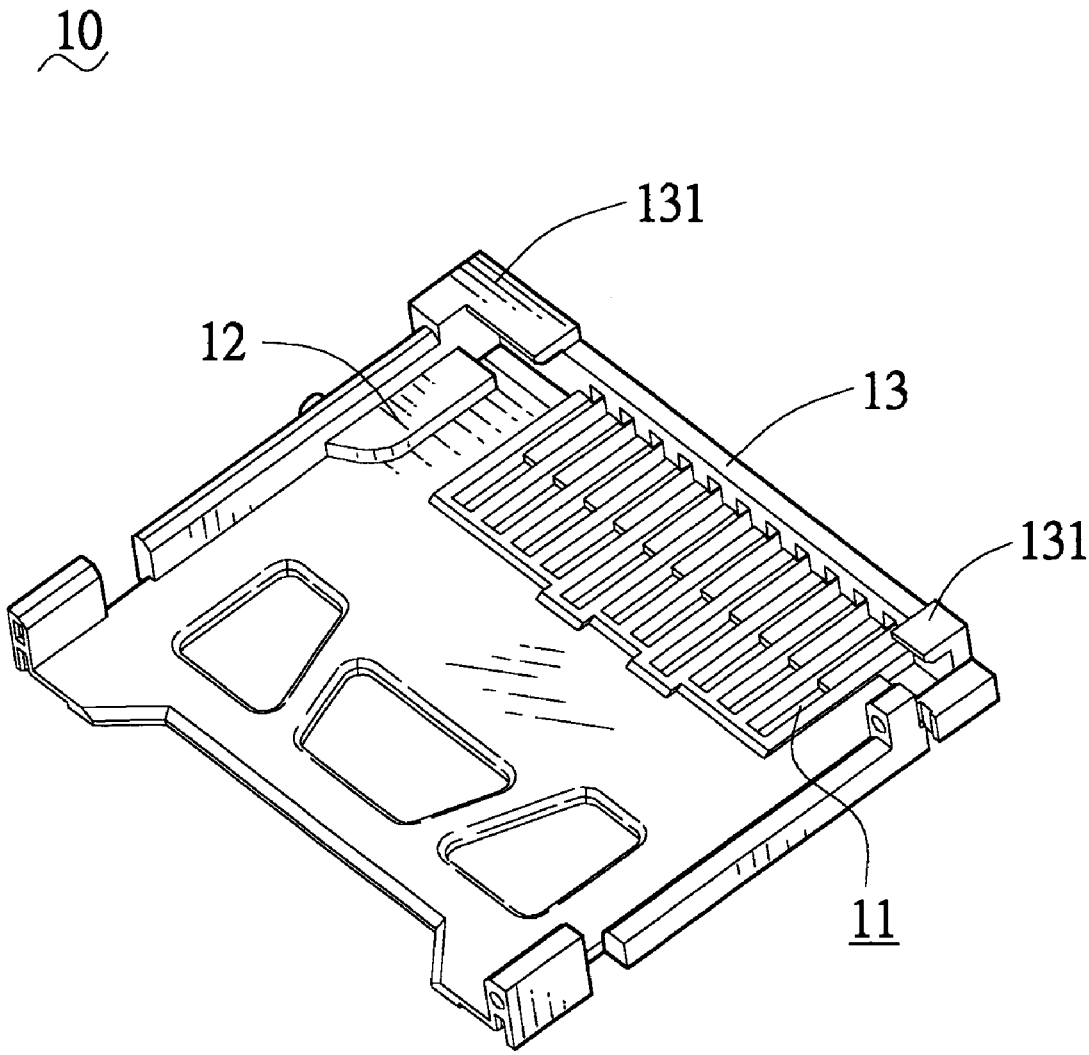
FIG. 2 shows an insulation body of the mini SD card connector.

As shown in FIG. 2, a plurality of channels 11 is formed in front of the insulation body 10. The channels 11 receive the insertion terminals 30. The insulation body 10 has a raised lump 12 in the left side of the channels 11. A wall 13 is arranged in front end of the insulation body 10. The insulation body 10 has at least a jam bulge 131 extending from the wall 13.

Figure 3:
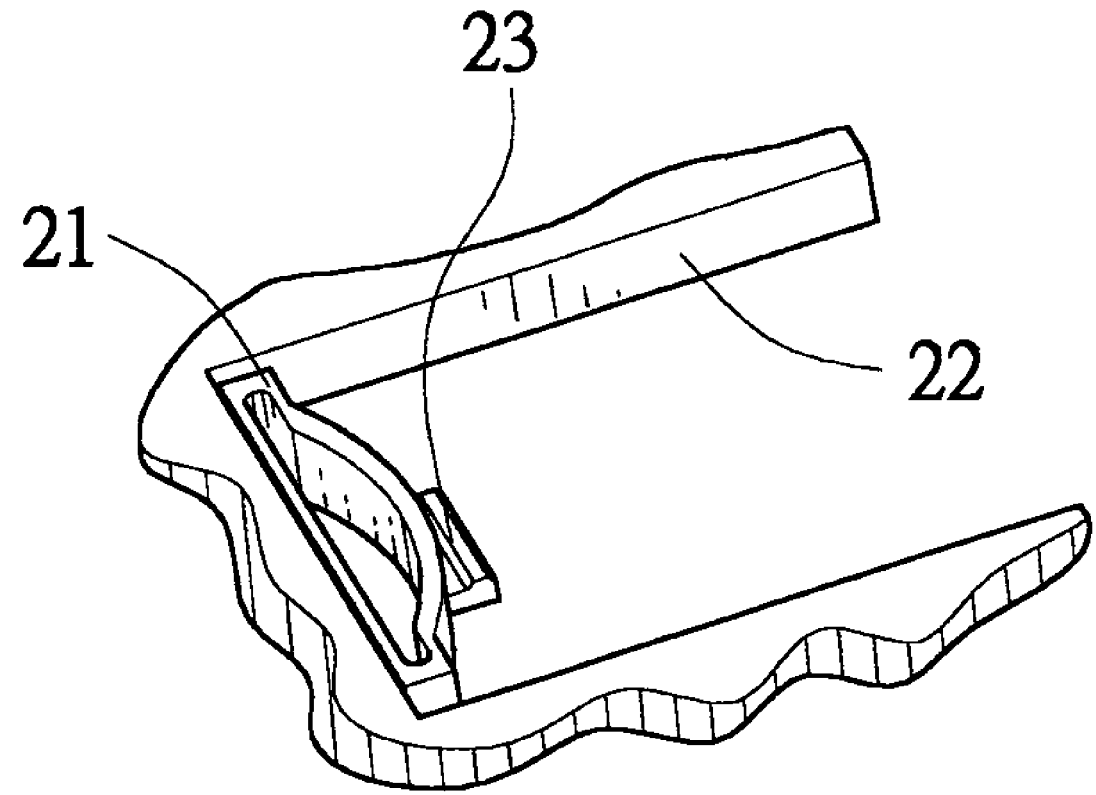
FIG. 3 shows a movable cover of the mini SD card connector.

Referring to FIG. 3, the movable cover 20 comprises a pressure plate 21, two side plates 22 forwardly and horizontally extended from the ends of the pressure plate 21 and perpendicularly to the pressure plate 21 and a folded panel 23 formed on the middle of the pressure plate 21.

Figure 4:
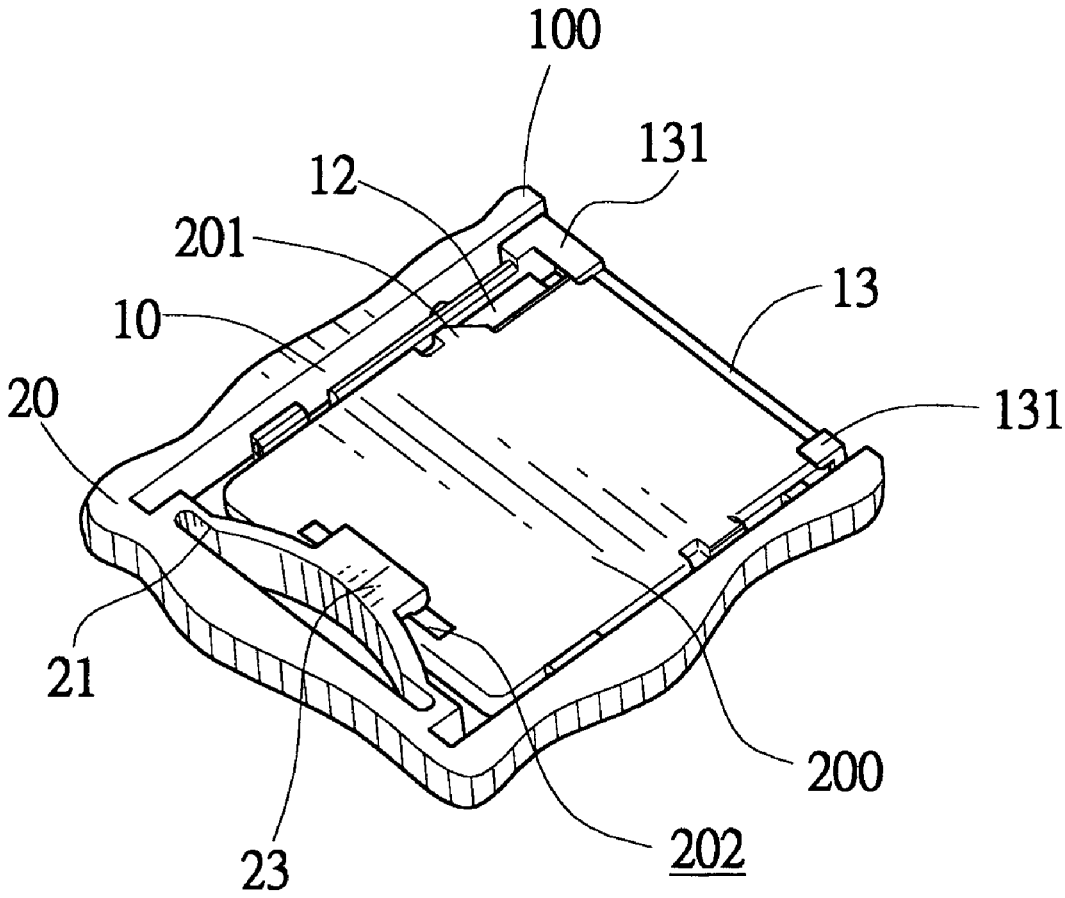
FIG. 4 shows the mini SD card connector receiving a mini SD.

Please refer to FIG. 4, when a mini SD card 200 is inserted into the insulation body 10 of the mini SD card connector 100, the raised lump 12 of the insulation body 10 is received in a groove 201 at the side of the mini SD card 200, in order to let the mini SD card 200 correctly and firmly held in the mini SD card connector 100. The jam bulges 131 of the insulation body 10 wedge with the front side of the mini SD card 200, so that the front of the mini SD card 200 is locked tightly. Then the movable cover 20 is padlocked the insulation body 10. The pressure plate 21 of the movable cover 20 is inserted into a channel 202 of the mini SD card 200. The channel 202 is formed at rear end of the mini SD card. Therefore, the mini SD card is firmly located at pre-determined position.

According to this invention, the mini SD card connector 100 locks the mini SD card 200. Moreover, the mini SD card connector 100 of this invention provides with the jam bulges 131 to wedge with the front side of the mini SD card 200, so that the entire mini SD card 200 is firmly and reliably locked in the mini SD card connector 100.

It is of course to be understood that the described herein are merely illustrative of the principles of the invention and that a wide variety of modifications thereto may be effected by persons skilled in the art without departing from the spirit and scope of the invention as set forth in the following claims.

What is claimed is:

1. A mini SD card connector comprising:

an insulation body, the insulation body having a plurality of channels to receive insertion terminals and at least one jam bulge arranged in a front end of the insulation body to wedge with a front side of a mini SD card;

a movable cover including a pressure plate extending transversely between two opposed side plates capturing the insulation body, the pressure plate having a bulbous intermediate portion and a folded panel projecting towards the insulation body therefrom to overhang a portion of a mini SD card received by the insulation body; and a plurality of insertion terminals arranged in the insulation body.

2. The mini SD card connector in accordance with claim 1, wherein the jam bulge is located in a wall which is arranged in the front end of the insulation body and fixes the front side of the mini SD card.

3. A mini SD card connector comprising:

an insulation body having a plurality of channels to receive a plurality of insertion terminals and at least one jam bulge arranged at a front end thereof for guidingly engaging a front side of a mini SD card;

a movable cover including a pressure plate extending transversely between a pair of opposed side plates capturing the insulation body, the pressure plate having a bulbous intermediate portion and a folded panel projecting towards the insulation body therefrom to overhang a portion of a mini SD card received by the insulation body, the bulbous intermediate portion of the pressure plate defining a looped contour; and, a plurality of insertion terminals arranged in the insulation body.

* * * * *